United States Patent [19]

Schmidt

[11] 4,222,595

[45] Sep. 16, 1980

[54] CLAMPING CLOSURE FOR RELEASABLY CONNECTING TWO PARTS

[75] Inventor: Guenther Schmidt, Baden-Baden, Fed. Rep. of Germany

[73] Assignee: The Parker Pen Co., Janesville, Wis.

[21] Appl. No.: 935,795

[22] Filed: Aug. 22, 1978

[30] Foreign Application Priority Data

Aug. 24, 1977 [DE] Fed. Rep. of Germany ..... 2738122

[51] Int. Cl.[2] ..... E05C 19/08

[52] U.S. Cl. ..... 292/91; 24/214

[58] Field of Search ..... 292/91, 303, DIG. 38; 24/213 R, 214, 215

[56] References Cited

U.S. PATENT DOCUMENTS

| | | | |
|---|---|---|---|
| 1,305,233 | 5/1919 | Ogden | 24/215 |
| 1,320,496 | 11/1919 | Roth | 24/214 |
| 1,325,577 | 12/1919 | Pilkington | 24/214 |
| 4,035,874 | 7/1977 | Liljendahl | 24/213 R X |

FOREIGN PATENT DOCUMENTS

| | | | |
|---|---|---|---|
| 637081 | 1/1928 | France | 24/214 |

*Primary Examiner*—Richard E. Moore

*Attorney, Agent, or Firm*—Bacon & Thomas

[57] ABSTRACT

A fastener of the snap fastener type having a base plate with a hollow cap secured to the base plate only by resilient hooked prongs extending through the base plate. A split resilient ring within the cap has opposed projections extending outwardly through the sides of the cap and have cam ends to permit extending the cap through a second plate by camming the projections inwardly until they have passed through the second plate where they spring outwardly to thus fasten the base plate and second plate together.

19 Claims, 7 Drawing Figures

CLAMPING CLOSURE FOR RELEASABLY CONNECTING TWO PARTS

Figure 5:
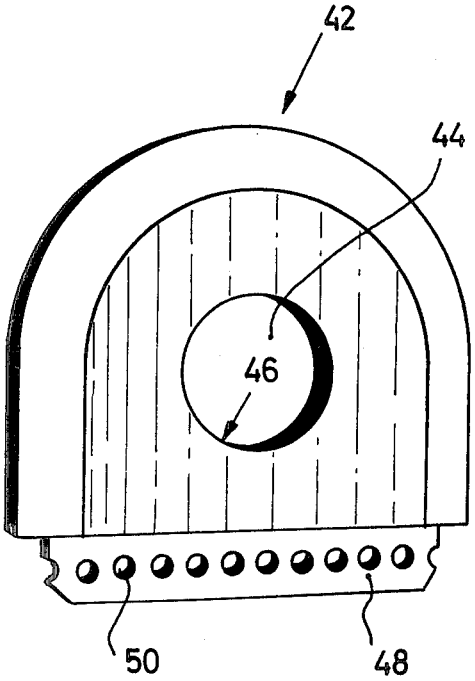

The invention relates to a fastener for the detachable connection of two members, particularly for the detachable connection of the closing flap of cases, folders, writing cases or the like with the structure forming the main body, with a lower part having a spring and an upper part which comes into detachable locking engagement with the spring on pressing together the upper part and the lower part.

Numerous different constructions of fasteners are known. The best known are conventional press fasteners which are generally made from metal.

The problem of the present invention is to provide a fastener of the type indicated hereinbefore which is reliable and can be easily manufactured from hard plastic materials, for example by injection moulding.

According to the invention, this problem is solved by a fastener for the detachable connection of two members of the type defined hereinbefore which is characterised in that the lower part has a base plate provided with four peripherally arranged openings which face one another in pairs and incorporate webs, a cap provided with four attachments corresponding to the openings, connectable with the base plate by pressing the attachments into the openings and outside the area of the webs having a part cylindrical peripheral wall with a lower height than the attachment, and a slotted annualar spring with two facing peripheral projections which, after assembly of the lower part, project radially and resiliently over the outer periphery of the cap into the web areas; and in that the upper part has a clamping plate with a circular opening substantially corresponding to the external diameter of the cap, whereby on the opening edge facing the lower part is provided an annular projection for pressing in the peripheral projections of the annular spring and for engaging between the latter and the base plates.

Particularly preferred embodiments of the invention are characterised in that the peripheral projections are slightly tapered at least from one flat side of the annular spring, that in the case of tapers of both sides of the peripheral projections the tapers have different gradients, that the tapers of at least one flat side of the annular spring start directly at the ring periphery and that the tapers of at least one side of the annular spring start at a spacing from the ring periphery, whilst before the end of the peripheral projection the tapers pass into a flat horizontal end portion. Due to this construction of the peripheral projections of the annular spring, the closing and opening forces to be overcome can be adjusted in random manner and independently of one another in accordance with the demands made on the particular fastener.

According to a preferred embodiment of the invention, a locking web extends radially into the cap from the peripheral wall of the cap asymmetrically to the facing web areas of the peripheral wall and that the slot of the slotted annular spring is also asymmetrical to the peripheral projections which pass through the openings on assembly. This ensures that without further precautions, the correct arrangement of the locking ring with different tapers for obtaining different opening or closing forces is ensured on assembling the cap, base plate and locking ring.

According to another preferred embodiment of the present invention, the base plate and clamping plate on a partly stepped edge which is flatter than the remainder of the plate are provided with sewing rings or eyes for sewing the fastener into the case or the like. As a result, the fastener according to the invention can be easily sewn to the flap and main body of the tape, folder or the like.

According to another embodiment of the invention, the base plate is extended on one side starting from the opening and this applies in particular with reference to cases for writing implements. As a result, the writing implement is reliably covered by the base plate and is protected from damage.

Other preferred embodiments of the invention are characterised in that particularly in the case of use on cases for writing implements, the base plate is given at least one longitudinally extending inserting slot on the side remote from the locking part, the inserting slot extends over the entire length of the optionally extended base plate and that particularly when used on cases for writing implements, the base plate has at least one longitudinally extending inserting slot on the side facing the locking part, that the inserting slot only has approximately the length of the locking spring of a writing implement and that the inserting slots on both sides directly face one another. This ensures a reliable firm hold of the writing implement or implements in the case. This is further aided by the fact that according to a further embodiment particularly applicable for cases for writing implements in an edge of the base plate which is opposite to the opening at a distance corresponding approximately to the length of a locking spring of a writing implement a depression is provided or the depression passes into an opening.

Figure 1:
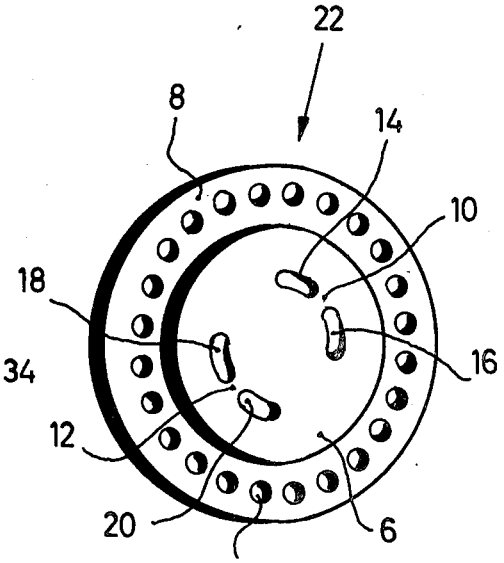

Further features and advantages of the invention can be gathered from the claims and following description in which individual embodiments are illustrated with reference to the drawings, wherein show:

FIG. 1 the base plate of the lower part with the side facing the locking plate.

Figure 2:
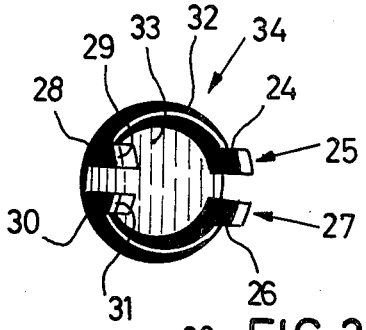

FIG. 2 the cap to be mounted on the base plate.

Figure 3:
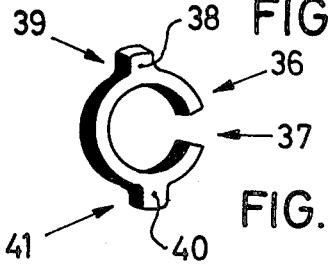

FIG. 3 the annular spring to be inserted in the cap.

Figure 4:
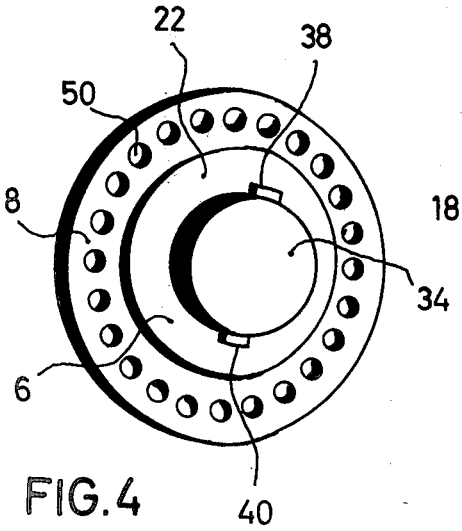

FIG. 4 the asembled lower part.

FIG. 5 the clamping plate.

Figure 6:
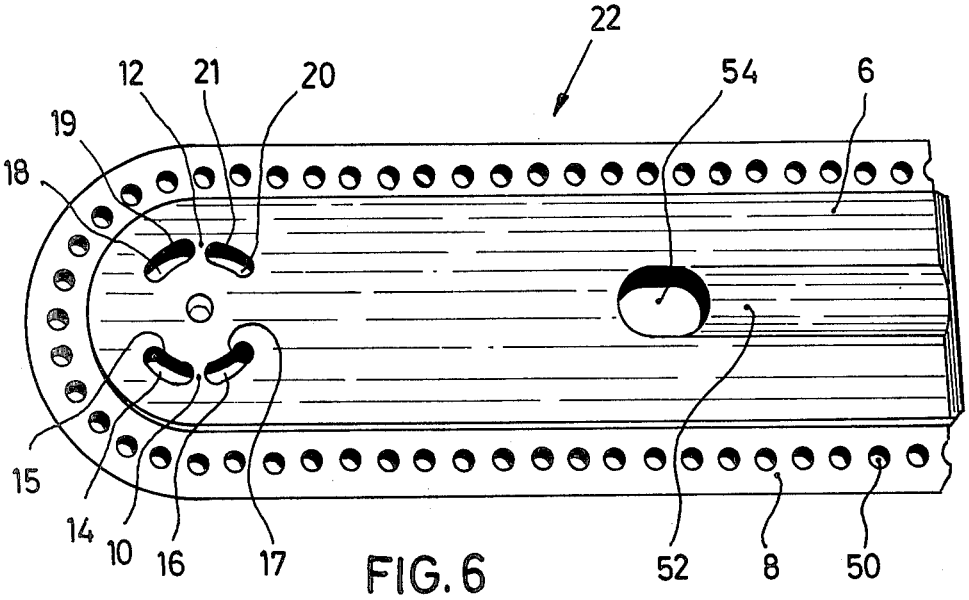

FIG. 6 another embodiment of the base plate of the lower part with the side remote from the clamping plate.

Figure 7:
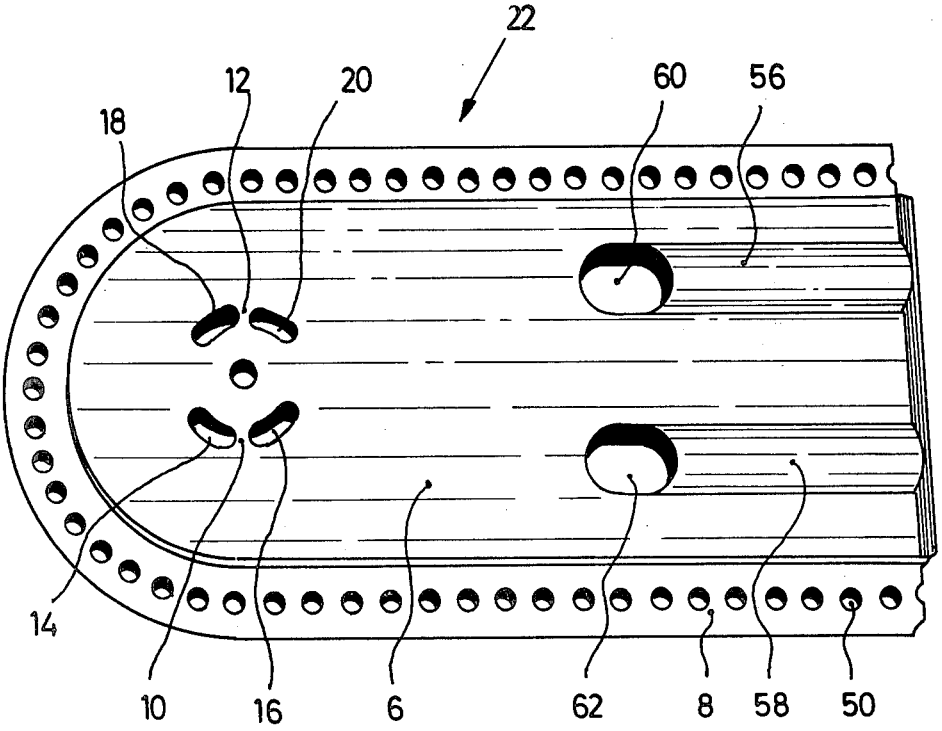

FIG. 7 a further embodiment of the base plate of the lower part with the side facing the clamping plate.

The base plate 32 shown in FIG. 1 has in the represented embodiment a circular central part 6 and a peripheral edge 8 stepped in shoulder-like manner which peripherally surrounds the central part 6. Base plate 22 is provided with four peripherally arranged openings 14, 16, 18, 20 which in pairs surround two facing webs 10, 12. Openings 14, 16, 18, 20 are extended towards the opposite side via shoulders 15, 17, 19, 21, as is visible in FIG. 6 which represents another embodiment.

Cap 34 shown in FIG. 2 has a peripheral wall 32 from which extend vertically towards the cover surface 33, four attachments 24, 26, 28, 30 corresponding to openings 14, 16, 18, 20. At their ends, attachments 24, 26, 28, 30 are provided with radially outwardly extending projections 25, 27, 29, 31 for engagement behind shoulders 15, 17, 18, 21.

Between the two adjacent closely juxtaposed attachments 24, 26 or 28, 30 the peripheral wall 32 is interrupted up to cover surface 33 at which point pass through the peripheral projections 38, 40 of the annular spring 36, shown in FIG. 3, to be inserted into cap 34. Annular spring 36 is not constructed as a solid ring and is instead interrupted at 37, so that it can be compressed when forces act on peripheral projections 38, 40.

In the represented embodiment, peripheral projections 38, 40 are on one side tapered by means of tapers 39, 41 from the edge of annular spring 36 to their end. As a result, the forces to be used for inserting or opening the fastener can differ as a function of the insertion of annular spring 36 into cap 34.

FIG. 4 shows the lower part comprising base plate 22, cap 34, and annular spring 36 in the assembled form. The peripheral projections 38, 40 of annular spring 36 which extends out of the cap are clearly visible.

FIG. 5 shows a clamping plate 32 of the upper part which has a circular opening 44 substantially corresponding to the diameter of cap 34. At the open edge of circular opening 34 facing the lower part is provided an annular projection 46 for pressing in the peripheral projections 38, 40 of annular springs 36 and for engagement between the latter and base plate 22.

In the represented embodiment, clamping plate 32 is substantially semicircular and is slightly flattened towards the semicircular periphery. An attachment 48 with a smaller thickness than clamping plate 42 is located at the straight end of the latter.

Attachment 48 of the upper part and peripheral edge 8 of the lower part are provided with the same rings or eyes 50 by means of which it is possible to sew the upper part and lower part to the case material, for example leather or a leather-like plastic material.

Two further embodiments of base plate 22 of the lower part are shown in FIGS.6 and 7. The represented embodiment of the lower part are intended for cases for writing implements, whereby the case provided with the lower part of FIG. 6 is intended for one writing implement and the case provided with the lower part in FIG. 7 is intended for two writing implements.

The base plate of FIG. 6 is visible from the side remote from the upper part. An inserting slot 52 extends over the entire length of base plate 22 and provides a firm lateral hold for a writing implement inserted into the case provided for said base plate. In alignment with inserting slot 52 is provided an opening 54 in which engages from the opposite side of the base plate the conventional thickened portion at the end of the clamping spring of writing implements.

FIG. 7 shows on the side of the lower part facing the upper part inserting slots 56, 58 for receiving the clamping spring of the writing implement, whose thickened end also engages in the represented openings 60, 62.

In each case, one of the represented lower parts and one of the represented upper parts of the fastener according to the invention are sewn by means of sewing rings 50 into a case, folder, writing implement or the like in such a way that for closing the case, folder or the like, the upper part generally connected to a flap of the case, folder or the like is firmly pressed onto the lower part, so that the peripheral projection 38, 40 of annular springs 36 engage behind the annular projection 46 of circular opening 44 of the clamping plate 42 of the upper part.

The fastener according to the invention can be used for all types of cases, for example writing cases for one or more writing implements, credit card cases, coin cases and key cases as well as wallets and folders.

The features of the invention disclosed in the description, drawings and claims both singly and in random combinations may be important for the realisation of the invention in its various embodiments.

I claim:

1. Fastener for the detachable connection of two members, particularly for the detachable connection of the closing flap of cases, folders, writing cases or the like with the structure forming the main body, with a lower part having a spring and an upper part which comes into detachable locking engagement with the spring on pressing together the upper part and the lower part, the improvement comprising: the lower part having a base plate (22) provided with four peripherally arranged openings (14, 16, 18, 20) therethrough which are arranged in pairs and incorporate webs (10, 12) therebetween, a cap (34) provided with four resilient attachments (24, 26, 28, 30) corresponding to the openings (14, 16, 18, 20), connectable with the base plate (22) solely by pressing the attachments into the openings (10, 12) said cap having a partly cylindrical peripheral wall (32) of a lesser height than the attachments (24, 26, 28, 30), and a slotted annular spring (36) within said cap with two oppositely facing peripheral projections (38, 40) which, project radially and resiliently outwardly of the outer periphery of the cap (34) over the web areas (10, 12); and an upper part having a clamping plate (42) with a circular opening substantially corresponding to the external diameter of the cap (34), whereby the opening (44) edge facing the lower part defines an annular surface (46) for pressing in the peripheral projections (38, 40) of the annular spring (37) and for engaging between the latter and the base plate 22.

2. Fastener according to claim 1, characterised in that the peripheral projections (38, 40) are slightly tapered from at least one flat side of the annular spring (36).

3. Fastener according to claim 2, characterised in that the tapers (39, 41) of at least one flat side of annular spring (36) start at a distance from the annular periphery.

4. Fastener according to claim 2, characterised in that the tapers (39, 41) pass into a horizontal flat end portion before the end of the peripheral projections (38, 40).

5. Fastener according to claim 1, characterised in that a locking web extends radially into the cap from the peripheral wall (32) of cap (34) and asymmetrically to the facing web areas of peripheral wall (32) and that the slot of the slotted annular spring (36) is also asymmetrical to the peripheral projections (38, 40) which extend through the openings on assembly.

6. Fastener according to claim 1, characterised in that at their ends attachments (24, 26, 28, 30) have radially projecting projections (25, 27, 29, 31) for engaging the remote wall portions of base plate (22) which defines the openings (14, 16, 18, 20).

7. Fastener according to claim 6, characterised in that the projections (25, 27, 29, 31) extend radially outwards.

8. Fastener according to claim 6, characterised in that the projections (25, 27, 29, 31) extend radially inwards.

9. Fastener according to claim 1, characterised in that from the end of the attachments (24, 26, 28, 30) the projections (25, 27, 29, 31) are slightly tapered towards their end.

10. Fastener according to claim 6, characterised in that on their side directed towards peripheral wall (32), projections (25, 27, 29, 31) extend in flat and perpendicular manner away from attachments (24, 26, 28, 30).

11. Fastener according to claim 6, characterised in that the openings (14, 16, 18, 20) have stepped shoulders (15, 17, 19, 21) corresponding to the projections (25, 27, 29, 31) of attachments (24, 26, 28, 30), whereby projections (25, 27, 29, 31) can engage behind said shoulders (15, 17, 19, 21).

12. Fastener according to claim 1, characterised in that the base plate (22) and clamping plate (42) are provided with a stepped edge (8, 48) which is thinner than the remainder of plate (22, 42) with sewing rings or eyes (50) for sewing the fastener into cases or the like.

13. Fastener according to claim 1, characterised in that the base plate (22) is extended from one side of the openings (14, 16, 18, 20).

14. Fastener according to claim 1, characterised in that at least one longitudinally extending inserting slot (52) is provided on the side of the base plate (22) remote from clamping plate (42).

15. Fastener according to claim 14, characterised in that the inserting slot (52) extends over the entire length of the extended portion of the base plate (22).

16. Fastener according to claim 1, characterised in that at least one longitudinally extending inserting slot (56 or 58) is provided on the side of the base plate (22) facing the clamping plate (42).

17. Fastener according to claim 16, characterised in that the inserting slot (56 or 58) only has approximately the same length as the spring clip of a writing implement.

18. Fastener according to claim 1, characterised in that a depression is provided on the edge of the base plate (22) opposite to openings (14, 16, 18, 20) and at a distance corresponding approximately to the length of the clamping spring of a writing implement.

19. Fastener according to claim 18, characterised in that the depression passes into an opening (54, 60, 62).

* * * * *